United States Patent [19]

Kastilahn

[11] 4,215,233

[45] Jul. 29, 1980

[54] HEATING ASSEMBLY WITH VIBRATION DAMPENING SHIPPING SUPPORTS FOR GRAPHITE HEATING ELEMENTS

[75] Inventor: William W. Kastilahn, Caledonia, Ill.

[73] Assignee: Alco Standard Corporation, Valley Forge, Pa.

[21] Appl. No.: 974,308

[22] Filed: Dec. 29, 1978

[51] Int. Cl.[2] ..... H05B 3/62; F27D 11/02

[52] U.S. Cl. ..... 13/25; 13/20; 13/22; 174/42; 206/443; 206/589; 188/1 B; 219/536; 219/546; 338/234

[58] Field of Search ..... 13/20, 22, 25, 31; 219/390, 523, 536, 537, 546, 552, 553; 188/1 B; 174/42, 146, 147; 338/234; 248/54, 63; 165/69; 224/42.45 R; 336/100; 206/65, 443, 489, 490, 589; 220/443, 444/447

[56] References Cited

U.S. PATENT DOCUMENTS

| | | | |
|---|---|---|---|
| Re. 19,525 | 4/1935 | Juffa | 206/589 |
| 1,112,325 | 9/1914 | Roberts et al. | 206/443 |
| 1,812,311 | 6/1931 | Wolf | 206/589 |
| 2,320,172 | 5/1943 | Brooke et al. | 13/20 |
| 2,457,262 | 12/1948 | Norquist | 206/65 |
| 2,969,416 | 1/1961 | McGovern | 174/42 |
| 3,246,073 | 4/1966 | Bouche et al. | 174/42 |
| 3,712,465 | 1/1973 | Deuschle | 206/443 |
| 4,130,185 | 12/1978 | Densmore | 174/72 X |
| 4,131,198 | 12/1978 | Fischer | 206/589 X |
| 4,135,053 | 1/1979 | Kastilahn et al. | 13/25 |

FOREIGN PATENT DOCUMENTS

| | | | |
|---|---|---|---|
| 1077102 | 7/1967 | United Kingdom | 174/42 |

*Primary Examiner*—Volodymyr Y. Mayewsky
*Attorney, Agent, or Firm*—Leydig, Voit, Osann, Mayer & Holt, Ltd.

[57] ABSTRACT

Electrical resistance heating elements made of graphite and disposed in a ceramic tube are protected against breakage during shipment by cardboard inserts which are telescoped over the heating elements and into the tube. When the heating elements are first energized, the inserts burn away into harmless ash which falls to the bottom of the tube.

5 Claims, 3 Drawing Figures

Fig. 1.
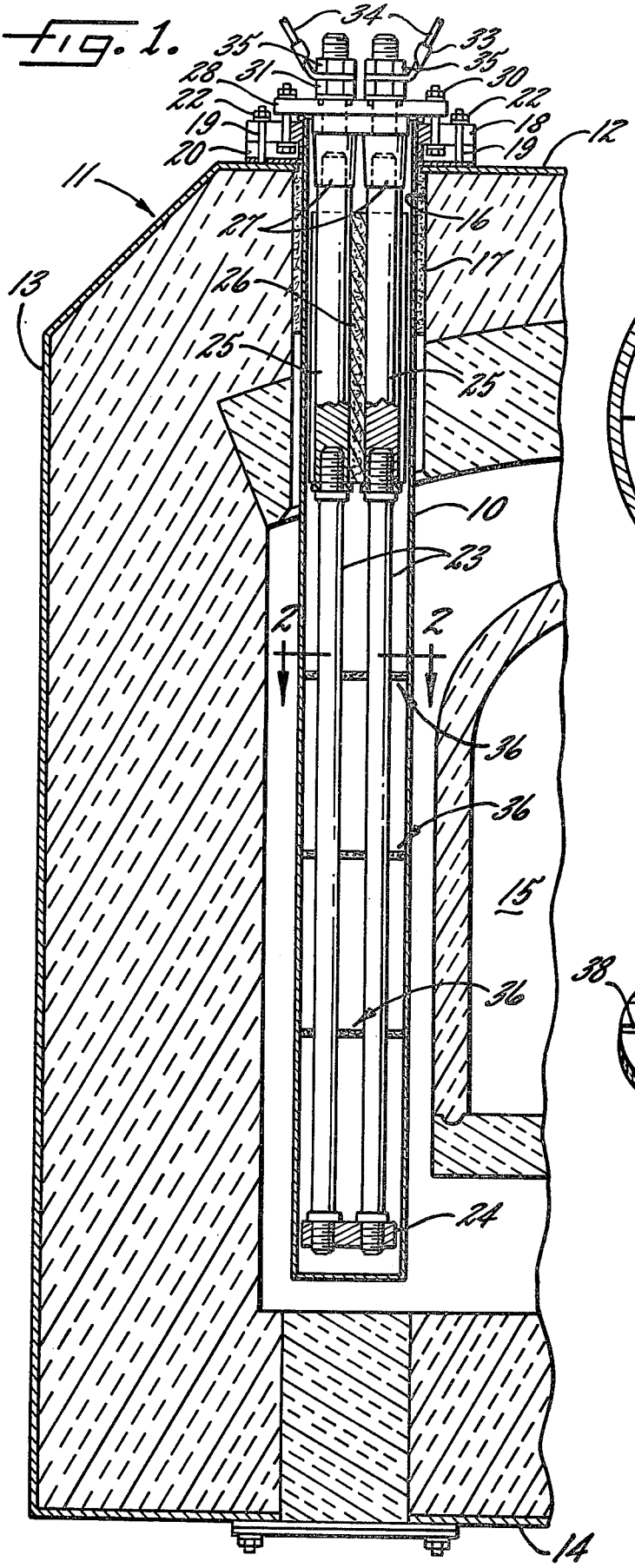
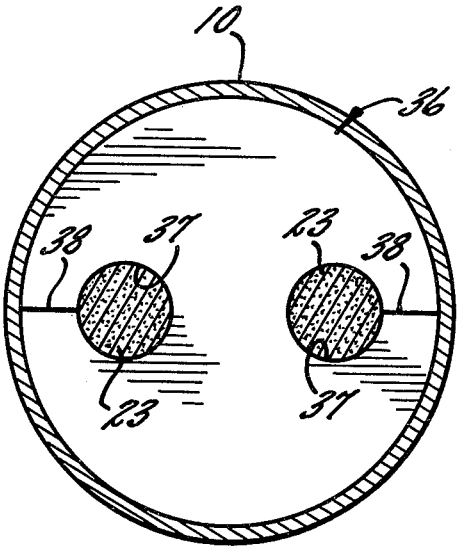
Fig. 2.
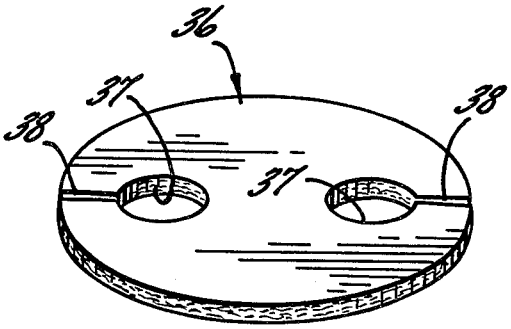
Fig. 3.

HEATING ASSEMBLY WITH VIBRATION DAMPENING SHIPPING SUPPORTS FOR GRAPHITE HEATING ELEMENTS

BACKGROUND OF THE INVENTION

This invention relates to a heating assembly of the type in which an electrical resistance heating element is disposed in a radiant tube.

A heating assembly of this general type is disclosed in Kastilahn et al U.S. Pat. No. 4,135,053. In that assembly, the heating element is in the form of an elongated graphite rod. It has been found that during shipment or transport of the heating assembly, the graphite heating element vibrates and may reach a harmonic that causes the graphite to break or crack. Moreover, this problem may occur whether the heating assembly is packaged and shipped independently of the furnace in which it is ultimately used or whether the assembly is shipped pre-installed in the furnace.

SUMMARY OF THE INVENTION

A principal object and aim of the present invention is to provide, for the graphite heating element, unique and relatively simple shipping supports to dampen the vibration of the graphite rod during shipment or transport.

A more detailed object is to provide shipping supports which reduce to harmless ash upon the initial energization of the heating element.

A further and related object is to provide shipping supports which do not emit toxic gases upon reduction to ash.

The invention also resides in the unique formation of the supports to enable the supports to be installed quickly and easily on the rods.

These and other objects and advantages of the invention will become more apparent from the following detailed description when taken in conjunction with the accompanying drawings. dr

BRIEF DESCRIPTION OF THE DRAWINGS

FIG. 1 is a fragmentary cross-section of an exemplary heat treating furnace equipped with a graphite heating element assembly incorporating the unique shipping supports of the present invention.

FIG. 2 is an enlarged view of one of the shipping supports as taken substantially along the line 2—2 of FIG. 1.

FIG. 3 is a perspective view of the shipping support shown in FIG. 2.

DETAILED DESCRIPTION OF THE PREFERRED EMBODIMENT

For purposes of illustration, the invention is shown in the drawings in conjunction with a heating assembly in which a heating tube 10 is disposed in a heat treating furnace 11 whose top, bottom and side walls 12, 13 and 14 define a chamber 15 in which workpieces (not shown) are placed for treatment.

Each heating tube 10 is made of a refractory ceramic material and is formed with an open upper end and a closed lower end. The upper end portion of each tube projects loosely through an opening 16 (FIG. 1) in the top wall 12 of the furnace 11 and is insulated with respect to the top wall by ceramic wool 17 or the like which is packed into the opening. Extending around the upper end portion of each tube is a ceramic collar 18 (FIG. 1) which is attached to the tube by a strong, heat-resistant cement. Angularly spaced studs 19 extend upwardly from the top wall 12 of the furnace and project through radially extending slots 20 formed in the collar 18, the collar being clamped against the top wall 12 by means of nuts 22 on the upper ends of the studs.

Heating of each tube 10 is effected by a pair of electrical resistance heating elements 23 (FIG. 1) which herein are in the form of two axially extending and radially spaced graphite rods. The two rods 23 are disposed in side-by-side relation in the tube and are coupled at their lower end by a graphite block 24 which connects the rods electrically in series. At their upper ends, the rods 23 are threaded into two graphite connector rods 25 which are surrounded by a cylindrical, heat-resistant block 26 of electrical insulating material.

Copper terminal studs 27 (FIG. 1) are threadably connected at their lower ends to the connector rods 25 and extend upwardly through a ceramic cap 28. The latter is clamped securely to the collar by bolts 30 which extend upwardly through the slots 20. Each terminal stud 27 is clamped against the cap 28 by a nut 31 and each receives a terminal 33 on the end of an electrical lead 34. The terminals are clamped against the nuts 31 by additional nuts 35 on the studs 27.

When the leads 34 are connected across a voltage source, current passes downwardly through one connector rod 25 and the connected heating rod 23, then across the connector block 24 and thence upwardly through the other heating rod 23 and the associated connector rod 25. Heat this is produced in the heating rods and the connector rods.

If the heating rods 23 are raised to a high temperature (e.g., about 1,000 degrees F.) in the presence of an oxidizing gas, the graphite will rapidly deteriorate or disintegrate and will experience an extremely short service life. It is conventional, therefore, to protect the heating rods with a non-oxidizing gas such as nitrogen. Herein, nitrogen is admitted into each tube 10 to purge the tube of other gases and to prevent oxidation of the heating rods 23.

When the furnace 11 is shipped or transported, the heating rods 23 tend to vibrate and may reach a harmonic that breaks the graphite and render it unsuitable for use. This will occur whether the heating assembly is shipped pre-installed in the furnace or whether it is packaged and shipped separately.

In accordance with the present invention, shipping support discs 36 are disposed in the tube 10 so as to dampen vibration of the rods 23 and thereby prevent damage to the rods. Moreover, the shipping support discs are self-destructing, that is, reducible to ash upon heating in an inert atmosphere, so that the shipping support discs need not be removed from the tube prior to putting the furnace into operation.

More specifically, the shipping support discs 36 are sized and shaped to telescope closely into the tube. The diameter of each circular disc is substantially equal to the inside diameter of the cylindrical tube 10 so that the disc will not move axially or radially within the tube once the disc 36 has been positioned in the desired location within the tube. Thus, a snug fit between the disc and tube is attained.

The discs 36 have circular openings 37 (FIG. 2) which are adapted to closely receive the graphite rods, the latter herein being of circular cross-section. The diameter of each opening 37 is substantially equal to the diameter of the respective graphite rod 23 so as to restrict axial and radial movement of the rod with respect to the disc and within the tube 10. Thus, vibration of the rods 23 is substantially dampened so as to reduce the danger of the rods being damaged during shipment.

A plurality of discs has been referred to thus far. It should be noted that the number of discs utilized is dependent upon the length of the graphite rods. Accordingly, with very short rods, it may be necessary to use only one support disc. With longer rods, however, several discs may be necessary. Typically, two to four axially spaced support discs will be used.

In keeping with the invention, slits 38 are formed through each disc 36 to permit the disc to be shipped around the heating rods 23 after the rods have been assembled with the connector block 24 and the connector rods 25. Herein, the slits extend radially from the openings 37 to the periphery of the disc.

To install each disc 36, the disc is slipped edgewise between the rods 23 after the rods have been assembled with the connector block 24 and the connector rods 25 but before the rods have been inserted into the tube 10. The disc then is turned to cause the slits to engage the rods. With continued turning of the disc, the rods spread the slits sufficiently to enable the rods to be received in the openings 37. Once the rods are so received, the slits contract and close around the rods. The rods with the attached discs then may be inserted into the tube 10.

Importantly, the shipping support discs 36 are made of a material which readily reduces to ash when the material is heated in an inert atmosphere such as nitrogen. Thus, the discs self-destruct when the heating rods 23 are first energized after shipment. Preferably, the discs are made of a wood or paper based material (e.g., cardboard) so that no harmful residue or ash is left in the tube and so that acrid or toxic gases are not emitted from the tube during reduction of the discs to ash.

Because the discs 36 are self-destruct, it is not necessary to disassemble the heating rods 23 and the tube 10 to enable removal of the discs after the furnace 11 has been shipped. Thus the furnace can be completely assembled and tested at the plant of the manufacturer and then the rods 23 can be removed from the tube 10 to enable installation of the discs. After the rods and tubes have been re-assembled and shipped to the ultimate user, there is no need to again perform disassembly and assembly operations to remove the shipping discs.

I claim:

1. A heating assembly comprising a closed tube, and an elongated rigid electrical resistance heating element disposed in and secured to said tube and having terminals adapted to be connected across a voltage source so as to energize said heating element and raise said heating element to a high temperature, the improvement in said heating assembly comprising, a support member for bracing said heating element against said tube to dampen the vibration of said element during shipment of said assembly thereby preventing damage to said element, said support member comprising a disc telescoped snugly over said heating element and telescoped snugly into said tube, said disc being made of a material which reduces to ash when said heating element is energized to a high temperature.

2. A heating assembly as defined in claim 1 in which said disc is made from a material selected from the group consisting essentially of wood or paper.

3. A heating assembly as defined in claim 2 in which aid disc is formed with an opening for receiving said heating element, and a slit formed through said disc and extending from said opening to the periphery of said disc.

4. A heating assembly comprising a closed tube, a plurality of axially extending and radially spaced rigid electrical resistance heating elements made of graphite disposed within and secured to said tube, said heating elements being connected together physically and electrically at their lower ends, and terminals adjacent the upper ends of said heating elements and adapted to be connected across a voltage source so as to energize said heating elements and raise said heating elements to a high temperature, the improvement in said heating assembly comprising, a plurality of axially spaced discs telescoped over said heating elements and into said tube, said discs snugly embracing said heating elements and snugly engaging said tube to dampen vibration of said heating elements during shipment of said assembly, said discs being made of paperboard and reducing to ash when said heating elements are energized to a high temperature.

5. A heating assembly as defined in claim 4 in which a plurality of openings is formed through each disc to receive said heating elements, and slits formed through each disc and leading from said openings to the periphery of said disc.

* * * * *